US011226114B2

(12) United States Patent
Dygert

(10) Patent No.: US 11,226,114 B2
(45) Date of Patent: Jan. 18, 2022

(54) INLET FOR AXIAL FAN

(71) Applicant: Carrier Corporation, Palm Beach Gardens, FL (US)

(72) Inventor: Ryan K. Dygert, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/099,121

(22) PCT Filed: May 3, 2017

(86) PCT No.: PCT/US2017/030728
§ 371 (c)(1),
(2) Date: Nov. 5, 2018

(87) PCT Pub. No.: WO2017/192647
PCT Pub. Date: Nov. 9, 2017

(65) Prior Publication Data

US 2019/0178252 A1 Jun. 13, 2019

Related U.S. Application Data

(60) Provisional application No. 62/330,975, filed on May 3, 2016, provisional application No. 62/330,963, filed
(Continued)

(51) Int. Cl.
*F24F 1/0029* (2019.01)
*F24F 1/029* (2019.01)
(Continued)

(52) U.S. Cl.
CPC ..... *F24F 1/029* (2019.02); *F04D 19/002* (2013.01); *F04D 25/12* (2013.01); *F04D 29/34* (2013.01);
(Continued)

(58) Field of Classification Search
CPC ..... F24F 1/0029; F24F 13/20; F24F 13/205; F04D 19/002; F04D 25/12; F04D 25/667;
(Continued)

(56) References Cited

U.S. PATENT DOCUMENTS 2,189,767 A 2/1940 Vose
2,287,822 A 6/1942 Odor et al.
(Continued)

FOREIGN PATENT DOCUMENTS

DE 202004005026 U1 9/2004
EP 1895166 A1 3/2008
(Continued)

OTHER PUBLICATIONS

ArchiExpo; CFM; "The Online Architecture and Design Exhibition", BIU Continental Fan Manufacturing Inc., 2019 VirtualExpo; Accessed Online: Dec. 7, 2018; 5 Pages. URL: www.archiexpo.com/prod/continental-fan-manufacturing-inc/product-10072-492474.html.

(Continued)

*Primary Examiner* — Richard A Edgar
*Assistant Examiner* — Aye S Htay
(74) *Attorney, Agent, or Firm* — Cantor Colburn LLP

(57) ABSTRACT

A fan assembly (10) includes a shrouded fan rotor (18) having a plurality of fan blades (22) extending from a rotor hub (24) and rotatable about a central axis (20) of the fan assembly, and a fan shroud (26) extending circumferentially around the fan rotor (18) and secured to an outer tip diameter of the plurality of fan blades (22). A fan casing (16) encloses the shrouded fan rotor (18). The fan casing (16) defines a fan inlet (30) of the fan assembly and includes an inlet extension (54) at an outer diameter of the fan casing, extending axially upstream of a conventional bell mouth inlet (58), relative to a direction of airflow through the shrouded fan rotor (18).

9 Claims, 3 Drawing Sheets

Related U.S. Application Data on May 3, 2016, provisional application No. 62/369,349, filed on Aug. 1, 2016.

(51) Int. Cl.

| | |
|---|---|
| ***F04D 29/54*** | (2006.01) |
| ***F04D 29/66*** | (2006.01) |
| ***F24F 1/0323*** | (2019.01) |
| ***F24F 1/0287*** | (2019.01) |
| ***F04D 19/00*** | (2006.01) |
| ***F04D 25/12*** | (2006.01) |
| ***F04D 29/34*** | (2006.01) |
| ***F24F 13/20*** | (2006.01) |
| *F04D 29/38* | (2006.01) |
| *F04D 25/06* | (2006.01) |

(52) U.S. Cl.

CPC ..... *F04D 29/541* (2013.01); *F04D 29/542* (2013.01); *F04D 29/667* (2013.01); *F24F 1/0029* (2013.01); *F24F 1/0287* (2019.02); *F24F 1/0323* (2019.02); *F24F 13/20* (2013.01); *F04D 25/06* (2013.01); *F04D 29/38* (2013.01); *F04D 29/544* (2013.01); *F24F 2013/205* (2013.01)

(58) Field of Classification Search

CPC ..... F04D 25/40; F04D 25/403; F04D 25/526; F04D 29/34; F04D 29/38

See application file for complete search history.

(56) References Cited

U.S. PATENT DOCUMENTS

| | | | | |
|---|---|---|---|---|
| 2,293,718 | A | 8/1942 | Eberhart | |
| 3,229,896 | A | 1/1966 | Levy | |
| 3,415,074 | A | 12/1968 | Metcalfe | |
| 3,702,220 | A | 11/1972 | Medawar et al. | |
| 3,846,039 | A | 11/1974 | Stalker | |
| 3,883,264 | A | 5/1975 | Rao | |
| 3,995,970 | A | 12/1976 | Nobuyuki | |
| 4,018,266 | A | 4/1977 | Kay | |
| 4,182,596 | A | 1/1980 | Wellman | |
| 4,566,852 | A * | 1/1986 | Hauser | B01D 53/005 123/41.49 |
| 4,971,603 | A | 11/1990 | Prinsloo et al. | |
| 5,489,186 | A * | 2/1996 | Yapp | F01D 5/141 415/208.3 |
| 5,525,036 | A | 6/1996 | Park | |
| 5,551,838 | A | 9/1996 | Hugbart | |
| 5,884,589 | A * | 3/1999 | Sakamoto | F01P 5/06 123/41.49 |
| 5,938,527 | A | 8/1999 | Oshima et al. | |
| 6,017,191 | A | 1/2000 | Harmsen | |
| 6,038,879 | A | 3/2000 | Turcotte et al. | |
| 6,101,829 | A | 8/2000 | Robinson | |
| 6,139,265 | A | 10/2000 | Alizadeh | |
| 6,195,983 | B1 | 3/2001 | Wadia et al. | |
| 6,398,492 | B1 | 6/2002 | Cho et al. | |
| 6,540,479 | B2 | 4/2003 | Liao et al. | |
| 6,663,342 | B2 | 12/2003 | Huang et al. | |
| 6,910,862 | B2 | 6/2005 | Horng et al. | |
| 6,997,678 | B2 | 2/2006 | Sun | |
| 7,220,102 | B2 | 5/2007 | Cho et al. | |
| 7,334,988 | B2 | 2/2008 | Horng et al. | |
| 7,377,751 | B2 | 5/2008 | Foster, Sr. et al. | |
| 7,416,386 | B2 | 8/2008 | Ho et al. | |
| 7,481,615 | B2 | 1/2009 | Park | |
| 7,618,233 | B2 | 11/2009 | Parker et al. | |
| 7,789,622 | B2 * | 9/2010 | Acre | F04D 29/164 415/209.3 |
| 7,824,154 | B2 | 11/2010 | Yabuuchi | |
| 7,942,627 | B2 | 5/2011 | Jin | |
| 8,056,352 | B2 | 11/2011 | Kang et al. | |
| 8,087,878 | B2 | 1/2012 | Chen | |
| 8,157,513 | B2 | 4/2012 | Takeshita et al. | |
| 8,197,198 | B2 | 6/2012 | Miyabara et al. | |
| 8,333,559 | B2 | 12/2012 | Bushnell | |
| 8,393,158 | B2 | 3/2013 | Conners | |
| 8,491,270 | B2 | 7/2013 | Eguchi et al. | |
| 8,573,343 | B2 | 11/2013 | Komatsu et al. | |
| 8,622,695 | B2 | 1/2014 | Decker et al. | |
| 8,696,305 | B2 | 4/2014 | Farlow et al. | |
| 8,740,562 | B2 | 6/2014 | Takemoto et al. | |
| 8,821,123 | B2 | 9/2014 | Camci et al. | |
| 8,887,486 | B2 | 11/2014 | Rosen et al. | |
| 9,033,656 | B2 | 5/2015 | Mizumi et al. | |
| 9,334,877 | B2 * | 5/2016 | Nicholls | F04D 29/52 |
| 9,850,914 | B2 * | 12/2017 | Dreesen | F04D 29/164 |
| 9,945,391 | B2 | 4/2018 | Hausmann | |
| 10,094,394 | B2 | 10/2018 | Heli | |
| 10,190,601 | B2 | 1/2019 | Dygert et al. | |
| 10,227,988 | B2 | 3/2019 | Gao et al. | |
| 10,428,829 | B2 | 10/2019 | Gebert et al. | |
| 2002/0159883 | A1 | 10/2002 | Simon et al. | |
| 2005/0042089 | A1 | 2/2005 | Horng et al. | |
| 2005/0186070 | A1 | 8/2005 | Zeng et al. | |
| 2005/0191955 | A1 | 9/2005 | Horng et al. | |
| 2006/0067816 | A1 | 3/2006 | Chang et al. | |
| 2006/0147304 | A1 | 7/2006 | Cho et al. | |
| 2006/0216147 | A1 | 9/2006 | Park | |
| 2007/0031248 | A1 | 2/2007 | Hsu et al. | |
| 2007/0154308 | A1 | 7/2007 | Yang | |
| 2011/0064571 | A1 | 3/2011 | Lind et al. | |
| 2013/0017081 | A1 | 1/2013 | Andrews | |
| 2013/0051997 | A1 | 2/2013 | Uchiyama et al. | |
| 2013/0315737 | A1 | 11/2013 | Dygert et al. | |
| 2014/0019970 | A1 | 1/2014 | Okamoto | |
| 2015/0030445 | A1 | 1/2015 | Gonidec et al. | |
| 2015/0065029 | A1 | 3/2015 | Leckelt et al. | |
| 2015/0098817 | A1 | 4/2015 | Innocenti | |
| 2015/0104303 | A1 | 4/2015 | Velthuis | |
| 2015/0275918 | A1 | 10/2015 | Hausmann | |
| 2015/0330411 | A1 | 11/2015 | Heli | |
| 2015/0354598 | A1 | 12/2015 | Dygert et al. | |
| 2015/0354841 | A1 | 12/2015 | Amr et al. | |
| 2017/0260985 | A1 | 9/2017 | Gao et al. | |
| 2018/0087513 | A1 | 3/2018 | Hoffman | |
| 2018/0106267 | A1 | 4/2018 | Gebert et al. | |
| 2019/0211843 | A1 | 7/2019 | Dygert | |
| 2019/0226688 | A1 | 7/2019 | Dygert et al. | |

FOREIGN PATENT DOCUMENTS

| | | | |
|---|---|---|---|
| EP | 2565467 | A2 | 6/2013 |
| EP | 2904277 | A2 | 8/2015 |
| GB | 2433772 | A | 4/2007 |
| JP | 2001182692 | A | 7/2001 |
| JP | 2011185166 | A | 9/2011 |
| JP | 2014020235 | A | 2/2014 |
| WO | 2014056657 | A2 | 4/2014 |
| WO | 2014109850 | A1 | 7/2014 |
| WO | 2017192644 | A1 | 11/2017 |
| WO | 2017192651 | A1 | 11/2017 |

OTHER PUBLICATIONS

Ohanian, O., "Ducted Fan Aerodynamics and Modeling, with Applications of Steady and Synthetic Jet Flow Control", Virginia Tech Electronic Theses and Dissertations, May 4, 2011, 203 Pages, Virginia Tech. URI: http://hdl.handle.net/10919/27687.

International Search Report for International Application No. PCT/US2017/030722; International Filing Date May 3, 2017; dated Jul. 14, 2017; 5 Pages.

International Search Report for International Application No. PCT/US2017/030728; International Filing Date May 3, 2017; dated Sep. 14, 2017; 7 Pages.

International Search Report for International Application No. PCT/US2017/030732; International Filing Date May 3, 2017; dated Sep. 14, 2017; 7 Pages.

(56) References Cited

OTHER PUBLICATIONS

Written Opinion for International Application No. PCT/US2017/030722; International Filing Date May 3, 2017; dated Jul. 14, 2017; 6 Pages.
Written Opinion for International Application No. PCT/US2017/030728; International Filing Date May 3, 2017; dated Sep. 14, 2017; 7 Pages.
Written Opinion for International Application No. PCT/US2017/030732; International Filing Date May 3, 2017; dated Sep. 14, 2017; 9 Pages.

* cited by examiner

INLET FOR AXIAL FAN

CROSS REFERENCE TO RELATED APPLICATIONS

This application is a National Stage application of PCT/US2017/030728, filed May 3, 2017, which claims the benefit of U.S. Provisional Application No. 62/330,975, filed May 3, 2016, U.S. Provisional Application No. 62/330,963, filed May 3, 2016, and U.S. Provisional Application No. 62/369,349, filed Aug. 1, 2016, all of which are incorporated by reference in their entirety herein.

BACKGROUND

The subject matter disclosed herein relates to vane axial flow fans. More specifically, the subject matter disclosed herein relates to structures to improve fan stall performance and/or improve stall recovery hysteresis performance of vane axial flow fans.

Axial flow fans are widely used in many industries ranging from automotive to aerospace to HVAC but are typically limited in their application by operating range restrictions and noise considerations. While vane-axial fans can achieve high static efficiencies, their limited operating range due to blade stall typically makes the vane-axial fan impractical for use in many systems that have extended operating range requirements. Furthermore, the stall and stall recovery performance of an axial fan can be degraded due to sensitivity to non-optimal or off-design inflow conditions. For example, when an axial fan is subjected to inflow that is substantially at a right angle to the axis of rotation of the fan, the fan may experience reduced stall performance and/or increased stall recovery hysteresis. In certain HVAC applications, such as an indoor fan system for a residential or commercial packaged product or split system, the reduction in operating range driven by this deficient stall/recovery hysteresis performance can hinder the application of vane-axial fan technology.

SUMMARY

In one embodiment, a fan assembly includes a shrouded fan rotor having a plurality of fan blades extending from a rotor hub and rotatable about a central axis of the fan assembly, and a fan shroud extending circumferentially around the fan rotor and secured to an outer tip diameter of the plurality of fan blades. A fan casing encloses the shrouded fan rotor. The fan casing defines a fan inlet of the fan assembly and includes an inlet extension at an outer diameter of the fan casing, extending axially upstream of a conventional bell mouth inlet, relative to a direction of airflow through the shrouded fan rotor.

Additionally or alternatively, in this or other embodiments the inlet extension extends between 5% and 20% of the fan rotor tip diameter axially upstream of the conventional bell mouth inlet.

Additionally or alternatively, in this or other embodiments the conventional bell mouth inlet transitions to the inlet extension, the inlet extension including a convex portion and a concave portion.

Additionally or alternatively, in this or other embodiments the concave portion extends from an inlet extension leading edge axially to a transition point and the convex portion extends from the transition point to a rotor leading edge.

Additionally or alternatively, in this or other embodiments the convex portion axially overlaps the fan shroud.

Additionally or alternatively, in this or other embodiments the inlet extension tapers radially from the conventional bell mouth inlet to an inlet extension leading edge at a taper angle.

Additionally or alternatively, in this or other embodiments the taper angle is between 0.5 degrees and 45 degrees.

Additionally or alternatively, in this or other embodiments a primary direction of airflow approaching the fan inlet is transverse relative to the central axis.

In another embodiment, a casing assembly for an axial fan includes a fan casing extending circumferentially about a central axis, the fan casing defining a fan inlet of the axial fan, and an inlet extension at an outer diameter of the casing, extending axially upstream of a conventional bell mouth inlet, relative to a direction of airflow through the shrouded fan rotor.

Additionally or alternatively, in this or other embodiments the inlet extension includes a concave surface extending from an inlet extension leading edge axially to a transition point and a convex portion extending axially rearwardly from the transition point.

Additionally or alternatively, in this or other embodiments the inlet extension is configured to extend axially upstream of a conventional bell mouth inlet, relative to a direction of airflow through the fan assembly.

Additionally or alternatively, in this or other embodiments the inlet extension is configured to extend between 5% and 20% of the fan rotor tip diameter axially upstream of the conventional bell mouth inlet.

Additionally or alternatively, in this or other embodiments the inlet extension tapers radially from the conventional bell mouth inlet to an inlet extension leading edge at a taper angle.

Additionally or alternatively, in this or other embodiments the taper angle is between 0.5 degrees and 45 degrees.

Additionally or alternatively, in this or other embodiments the inlet extension is configured to axially overlap a fan shroud of the fan assembly.

Additionally or alternatively, in this or other embodiments a primary direction of airflow approaching the fan inlet is transverse relative to the central axis.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

Figure 1:
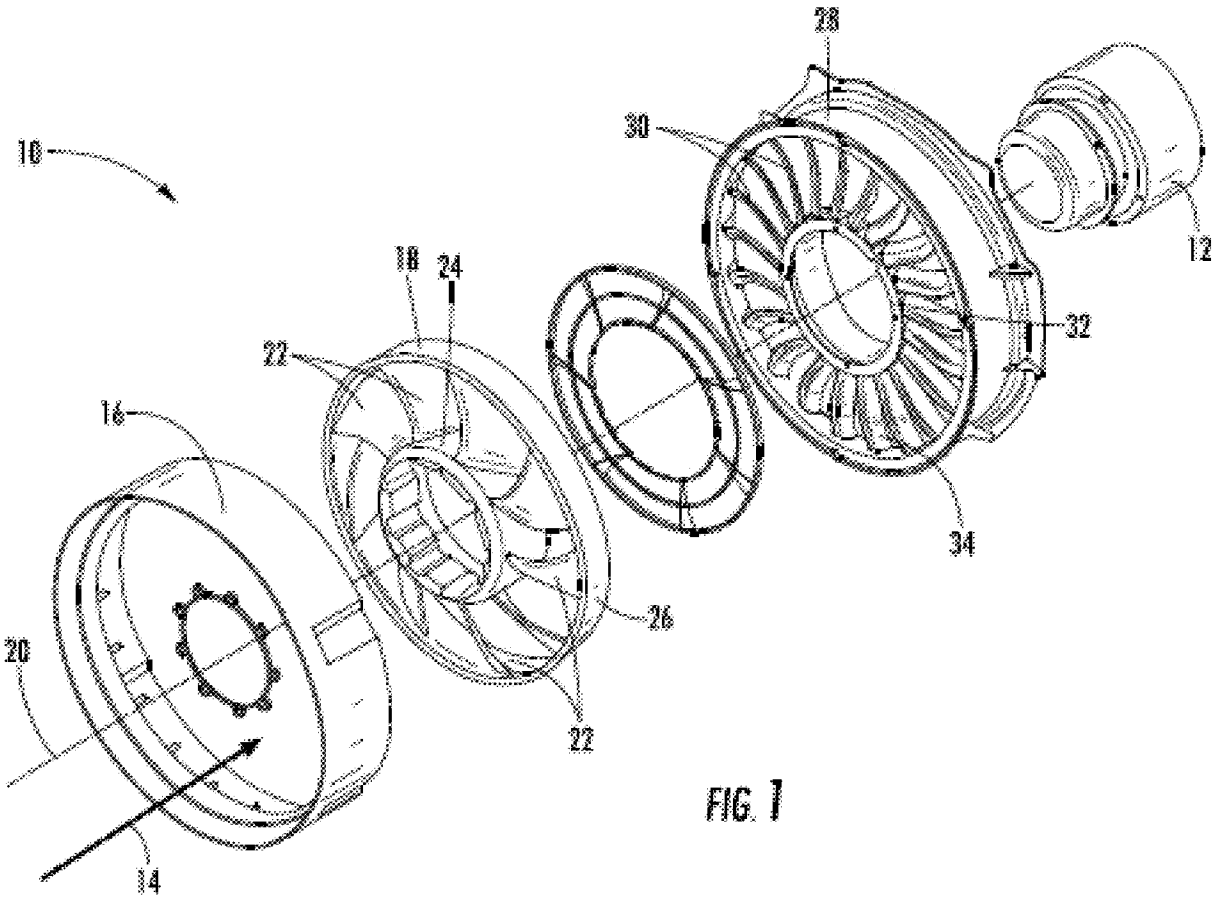
FIG. 1 is a perspective view of an embodiment of a fan assembly.

The detailed description explains embodiments of the invention, together with advantages and features, by way of example with reference to the drawing.

DETAILED DESCRIPTION

Shown in FIG. 1 is a partially exploded perspective view of an embodiment of an axial-flow fan 10 utilized, for example in a heating, ventilation and air conditioning (HVAC) system as an air handling fan. The fan 10 may be driven by an electric motor 12 connected to the fan 10 by a shaft (not shown), or alternatively a belt or other arrangement. In operation, the motor 12 drives rotation of the fan 10 to urge airflow 14 across the fan 10 and along a flowpath, for example, to or from a heat exchanger (not shown). The fan 10 includes a casing 16 with a fan rotor 18, or impeller rotably located in the casing 16. Operation of the motor 12 drives rotation of the fan rotor 18 about a fan axis 20. The fan rotor 18 includes a plurality of fan blades 22 extending from a hub 24 and terminating at a fan shroud 26. The fan shroud 26 is connected to one or more fan blades 22 of the plurality of fan blades 22 and rotates about the fan axis 20 therewith. The fan 10 further includes a stator assembly 28 including a plurality of stator vanes 30, located downstream of the fan rotor 18. The plurality of stator vanes 30 extend substantially radially from a stator hub 32 to a stator shroud 34.

Figure 2:
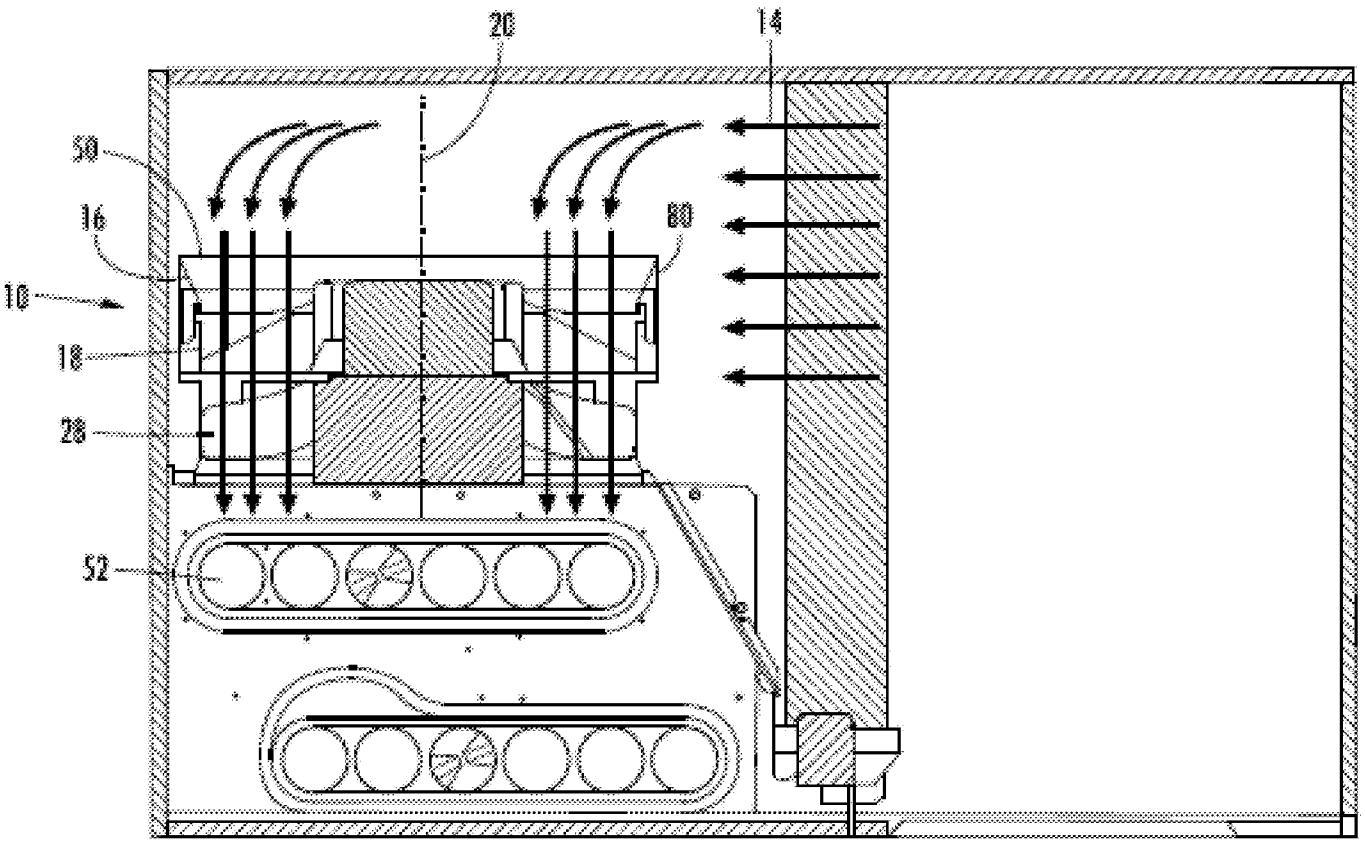
FIG. 2 is another cross-sectional view of an embodiment of a fan assembly.

Referring now to FIG. 2, in some applications, such as a rooftop or other packaged product heating, ventilation, air conditioning and refrigeration (HVAC&R) system, the fan 10 is oriented such that the airflow 14 directed at a fan inlet 50 of the fan 10 is from a direction predominantly perpendicular to the fan axis 20. Thus, to flow along the fan axis 20, the airflow 14 must be turned 90 degrees before flowing through the fan 10 and, for example, across a downstream heat exchange surface 52 of the HVAC&R system. This side-flow condition at the fan inlet 50 can result in poor stall and stall recovery hysteresis performance of the fan 10, and may limit an operating range of the fan 10, and thus its use in such applications.

Figure 3:
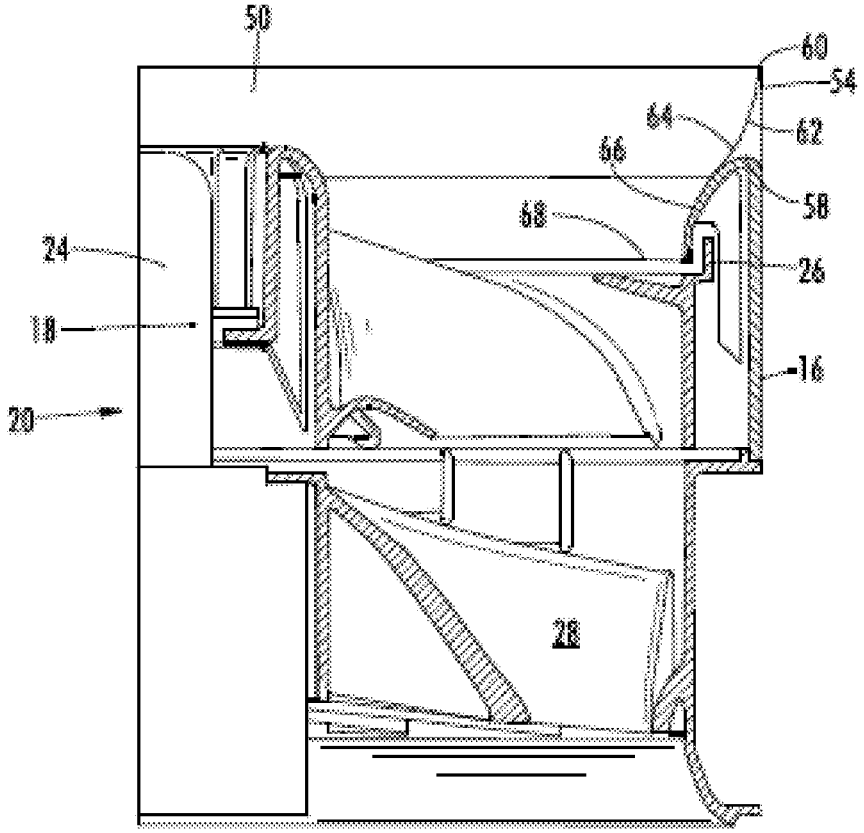
FIG. 3 is another partial cross-sectional view of an embodiment of a fan assembly.

Referring now to FIG. 3, the fan inlet 50 includes a casing extension 54 extending axially forward of a conventional bell mouth inlet 58, in some embodiments the casing extension 54 extends in the range of about 5% to about 20% of the fan rotor tip diameter axially forward of a conventional bell mouth inlet 58. The casing extension 54 provides axial distance for turning of the airflow 14 toward the axial direction along the fan axis 20 prior to entering the fan rotor 18. With a casing extension 54 length of about one inch, a reduction in stall recovery hysteresis of about 70% has been achieved, when compared with a comparable fan without the casing extension 54 that is applied in an installation with predominantly perpendicular inflow as shown in FIG. 2.

The casing extension 54 extends axially upstream of a conventional bell mouth inlet 58 to condition the airflow 14 prior to the airflow entering the fan rotor 18. A casing extension leading edge 60 defines an axially forward-most portion of the casing extension 54. In some embodiments, the casing extension 54 is formed integral with the conventional bell mouth inlet 58, while in other embodiments the casing extension 54 is a separate component from and discontinuous with the conventional bell mouth inlet 58.

In some embodiments, the casing extension 54 is an axial ring extending upstream of the conventional bell mouth inlet 58. In other embodiments, the casing extension 58 transitions from the conventional bell mouth inlet 58 at an inlet angle 80 (shown in FIG. 2). In some embodiments, the inlet angle 80 is in the range of 0.5 degrees to 45 degrees, with in other embodiments, the inlet angle 80 is between 10 and 40 degrees, while in still other embodiments the inlet angle 80 is between 15 and 30 degrees.

In some embodiments, as shown in FIG. 3, the casing extension leading edge 60 transitions to the conventional bell mouth inlet 58 via a concave portion 62 extending from the casing extension leading edge 60 axially to a transition point 64, and a convex portion 66 extending from the transition point 64 to a rotor leading edge 68. In some embodiments, the convex portion 68 axially overlaps the fan shroud 26.

While ideally an axially longer casing extension 54 improves the condition of airflow 14 entering the fan rotor 18, the performance improvement of the fan 10 must be balanced with packaging constraints on the fan 10.

The utilization of casing extension 54 in the fan 10 improves stall performance of the fan 10 and further reduces stall recovery hysteresis in comparison to prior fans. These improvements allow for expansion of the operating envelope of shrouded axial fans, thus increasing their applicability to a wide range of conditions, such as rooftop HVAC&R systems, allowing such systems to take advantage of the performance advantages of shrouded axial fans.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A fan assembly, comprising a shrouded fan rotor:

a plurality of fan blades extending from a rotor hub and rotatable about a central axis of the fan assembly; and a fan shroud extending circumferentially around the shrouded fan rotor and secured to an outer tip diameter of the plurality of fan blades; and a fan casing enclosing the shrouded fan rotor, the fan casing defining a fan inlet of the fan assembly and including an inlet extension at an outer diameter of the fan casing, extending axially upstream of a bell mouth inlet, relative to a direction of airflow through the shrouded fan rotor;

wherein the inlet extension axially overlaps the fan shroud radially inboard of the fan shroud;

wherein the bell mouth inlet transitions to the inlet extension, the inlet extension including a convex portion and a concave portion; and wherein the concave portion extends from an inlet extension leading edge axially to a transition point and the convex portion extends from the transition point to a rotor leading edge.

2. The fan assembly of claim 1, wherein the convex portion axially overlaps the fan shroud.

3. The fan assembly of claim 1, wherein the inlet extension tapers radially from the bell mouth inlet to an inlet extension leading edge at a taper angle.

4. The fan assembly of claim 3, wherein the taper angle is between 0.5 degrees and 45 degrees.

5. The fan assembly of claim 1, wherein a primary direction of airflow upstream of the inlet extension leading edge is transverse relative to the central axis.

6. A casing assembly for an axial fan, comprising a fan casing extending circumferentially about a central axis, the fan casing defining a fan inlet of the axial fan; and an inlet extension at an outer diameter of the fan casing, extending axially upstream of a bell mouth inlet, relative to a direction of airflow through a shrouded fan rotor disposed in the casing assembly;

wherein the inlet extension axially overlaps a fan shroud of the shrouded fan rotor radially inboard of the fan shroud;

wherein the bell mouth inlet transitions to the inlet extension, the inlet extension including a convex portion and a concave portion; and wherein the concave portion extends from an inlet extension leading edge axially to a transition point and the convex portion extends from the transition point to a rotor leading edge of the shrouded fan rotor.

7. The casing assembly of claim 6, wherein the inlet extension tapers radially from the bell mouth inlet to the inlet extension leading edge at a taper angle.

8. The casing assembly of claim 7, wherein the taper angle is between 0.5 degrees and 45 degrees.

9. The casing assembly of claim 6, wherein a primary direction of airflow upstream of the inlet extension leading edge is transverse relative to the central axis.

* * * * *